US007353682B2

(12) United States Patent
Buchanan

(10) Patent No.: US 7,353,682 B2
(45) Date of Patent: Apr. 8, 2008

(54) PIPE FLARING TOOL

(75) Inventor: Nigel Alexander Buchanan, Fife (GB)

(73) Assignee: American Grease Stick Company, Muskegon Heights, MI (US)

( * ) Notice: Subject to any disclaimer, the term of this patent is extended or adjusted under 35 U.S.C. 154(b) by 84 days.

(21) Appl. No.: 10/527,919

(22) PCT Filed: Sep. 16, 2003

(86) PCT No.: PCT/GB03/04107

§ 371 (c)(1),
(2), (4) Date: Aug. 22, 2005

(87) PCT Pub. No.: WO2004/024365

PCT Pub. Date: Mar. 25, 2004

(65) Prior Publication Data

US 2006/0144116 A1 Jul. 6, 2006

(30) Foreign Application Priority Data

Sep. 16, 2002 (GB) ..... 0221398.1

(51) Int. Cl.
*B21D 41/02* (2006.01)

(52) U.S. Cl. ..... 72/317; 72/370.11

(58) Field of Classification Search ..... 72/316–318, 72/116, 370.11, 370.1
See application file for complete search history.

(56) References Cited

U.S. PATENT DOCUMENTS

| | | | | |
|---|---|---|---|---|
| 1,795,358 A | | 3/1931 | Arndt | |
| 2,480,762 A | * | 8/1949 | Parker | 72/312 |
| 2,774,408 A | * | 12/1956 | Franck | 72/317 |
| RE24,325 E | * | 6/1957 | Franck | 72/317 |
| 2,993,522 A | | 7/1961 | Temple et al. | |
| 3,820,375 A | | 6/1974 | Koski | |
| 5,134,872 A | * | 8/1992 | Ose | 72/318 |
| 6,508,097 B2 | * | 1/2003 | Ose | 72/312 |
| 2001/0035038 A1 | | 11/2001 | Ose | |

FOREIGN PATENT DOCUMENTS

| | | | |
|---|---|---|---|
| EP | 0501928 A1 | | 9/1992 |
| FR | 2660219 | | 10/1991 |
| GB | 1442123 | | 7/1976 |
| GB | 1598204 | | 9/1981 |
| WO | WO 02/13992 A1 | * | 2/2002 |

* cited by examiner

*Primary Examiner*—Daniel C Crane
(74) *Attorney, Agent, or Firm*—Ostrager Chong Flaherty & Broitman P.C.

(57) ABSTRACT

A pipe flaring apparatus for use in flaring the end of a pipe preferably comprises a housing, a three jaw clamping chuck (3) in the housing which clamps the pipe (11) as the chuck (3) is propelled along an inclined surface (10*a*) of a chuck clamp (10) also in the housing by the operation of an outer piston (4) slidable in the housing by mechanical or hydraulic means. An inner piston (5) also mounted in the housing and preferably within the outer piston propels the required flaring tool (6) inwardly compressing pipe end (11*a*) between the clamping chuck die (3*a*) and a pipe flaring tool forming face (6*b*) to form an appropriate flare (11*b*) on the pipe end (11*a*). When the inner and outer pistons (4, 5) are deactivated resilient members preferably in the form of helical compression springs (8*a*, 8*b*) disengage the flaring head tool (6) and the clamping chuck (3) from the flared pipe (11*a*). The pipe (11) can easily be withdrawn through the chuck (3) and chuck clamp (10).

21 Claims, 5 Drawing Sheets

PIPE FLARING TOOL

This application is a 371 of PCT/GB03/04107, filed Sep. 16, 2003.

FIELD OF THE INVENTION

This invention relates to a hand held apparatus for flaring end portions of metal or plastic pipes or tubes into single or double flares.

The invention can have particular effect in tools for the flaring of automotive brake and fuel pipes whilst the pipe is still fitted to a vehicle.

BACKGROUND OF THE INVENTION

Various types of pipe flaring tools are known. However, such tools usually involve several disadvantages in providing proper flaring especially on steel pipes. A dual split die may be used to clamp the pipe to be worked. However, substantial abutment surfaces on the split die are prone to the build up of foreign bodies and corrosion preventing adequate clamping of the worked pipe. The final closure of the split die is usually affected by the use of a nut or similar device in conjunction with a screw threaded portion—such procedure is both time consuming and awkward as a hand held flaring tool is required to be held in one hand and an operating nut turned by a wrench or socket held in the other hand.

Once the pipe to be flared is clamped with the flaring head located adjacent the flaring tool, the pipe to be worked is moved towards the flaring tool to flare the pipe end by the operation of a nut and fine threaded portion, or a screw operated hydraulic apparatus. The flaring head is disengaged by reversing the operation of the nut and threaded portion or hydraulic apparatus.

Therefore, the operation of known "Hand held" pipe flaring tools is not only very awkward and time consuming but the risk of damaging or kinking the pipe to be flared is very high. Furthermore, the surface of the portion of pipe being clamped is invariably damaged, in part due to variance in both the sizes of the pipes being clamped and inadvertent operator handling.

STATEMENTS OF INVENTION

It is therefore, an object of the present invention to provide a pipe flaring apparatus for flaring end portions of pipes which provide a more rapid, convenient and efficient pipe flaring operation than hitherto known.

According to one aspect of the present invention there is provided a pipe flaring apparatus comprising a housing, a multi-jawed chuck located in the housing for supporting a pipe therein to be flared, means in the housing for opening or closing the jaws of the chuck to clamp the jaws on to the pipe, and further means in the housing being operable to flare the ends of the pipe clamped in the jaws.

In one embodiment in accordance with the present invention the multi-jawed chuck may comprise a tapered external surface. Conveniently, the means for closing the jaws of the chuck comprises a chuck clamp having a tapered internal surface generally complementary to the external tapered surface of the multi-jawed chuck and effects closing of the jaws of the chuck as the chuck is moved inwardly relative to the chuck clamp.

Preferably, the further means comprises a flaring tool which may be mounted on moveable means which comprises a piston for moving the flaring tool into engagement with the end of the pipe to be flared. Conveniently, the piston comprises first and second pistons wherein the second piston is adapted to move the multi-jawed chuck into engagement with the chuck clamp to close the jaws of the chuck about the pipe. The flaring tool may be mounted on the first piston for movement therewith. The first piston may be slidable relative to the second piston. Preferably, the first piston is slidable within the second piston.

Biasing means may be located between the first (inner) and second (outer) pistons for retracting the flaring tool from the pipe after the pipe is flared. Such biasing means may be located between closing means and the multi-jawed chuck for separating the closing means and multi-jawed chuck. Such biasing means may be located between the jaws of the chuck to open the jaws to disengage the flared pipe from the pipe flaring apparatus.

Conveniently, hydraulic means may be provided for moving the closing and flaring means to close the jaws of the chuck and engage the flaring means within the pipe. Conveniently, a tool holder supports the flaring means and the tool holder extends transversely relative to a longitudinal axis of the housing. The housing preferably includes two diametrically opposed windows through which the tool holder is arranged to extend. The tool holder may extend through a recess in the flaring means. Although the tool holder is slidably mounted on the flaring means it may be fixed relative to a longitudinal axis of the flaring means. Preferably, a flaring tool is mounted on the tool holder.

According to a second aspect of the present invention there is provided a method of flaring a pipe comprising inserting a pipe to be flared into a housing and through a multi-jawed chuck and closing means for closing the jaws of the chuck, and operating flaring means located in the housing to flare the end of the pipe.

In another embodiment in accordance with the present invention the method comprises closing the jaws of the chuck to clamp the jaws around the pipe to support the pipe during flaring or interengaging complementary tapering surfaces of the multi-jawed chuck and the chuck clamp. Preferably, the flaring means is moved to flare the pipe. Conveniently, moving the flaring means comprises moving a piston to which a flaring tool is attached for flaring the end of a pipe. Preferably moving the piston comprises moving a first and a second piston. Preferably, the second piston is moved to close the jaws of the multi-jawed chuck. The method also comprises moving the first piston to effect flaring of the pipe. Conveniently, the first piston is moved relative to the second piston and it is preferred that the first piston moves within the second piston.

The first (inner) piston may be biased relative to the second (outer) piston for retracting the flaring tool from the pipe after the pipe is flared. Moreover, the multi-jawed chuck is biased relative to the chuck clamp to disengage the flared pipe from the flaring apparatus. Preferably, hydraulic actuating means is operated to close the jaws of the chuck and engage the flaring means with the pipe. Conveniently, a tool holder may be moved transversely of the holding means to locate a flaring tool for flaring a pipe.

Therefore, in accordance with the present invention there may be provided a pipe flaring apparatus which efficiently and readily produces a single or double flare on a like sized pipe end portion, and in particular, but not solely, an apparatus capable of being "hand held" in order to be capable of conveniently flaring pipe ends of pipes still fitted to a vehicle for example.

Conveniently such a pipe flaring apparatus may allow the worked pipe to be held in one hand and the compact pipe flaring apparatus to be held in the other hand, which greatly reduces or substantially eliminates damage by inadvertently kinking the worked pipe at the point where the pipe enters the tool apparatus.

Furthermore, while such an apparatus enables closely but differently sized pipes to be clamped by the same apparatus, it allows the surface of the pipe to remain free of damage by clamping, the abutting surfaces of the pipe clamping chuck being substantially resilient to any build up of foreign bodies upon the external surface of the pipe.

Advantageously, such an apparatus substantially reduces the labour and time involved in providing flares on the ends of the pipes or tubes.

In an alternative embodiment in accordance with the present invention, the operation of the inner and outer pistons may be by a mechanical cable or hydraulic screw arrangement. Moreover, while the above described embodiments refer to the flaring of pipes, the pipes may themselves be formed of metal or plastics material.

BRIEF DESCRIPTION OF THE DRAWINGS

Embodiments of the invention will now be described by way of example with reference to the accompanying drawings, in which.

DETAILED DESCRIPTION OF EMBODIMENTS

Embodiments of the present invention will now be described with reference to the drawings. In the various embodiments described below like reference numbers will be used to indicate like features throughout the drawings.

Figure 1:
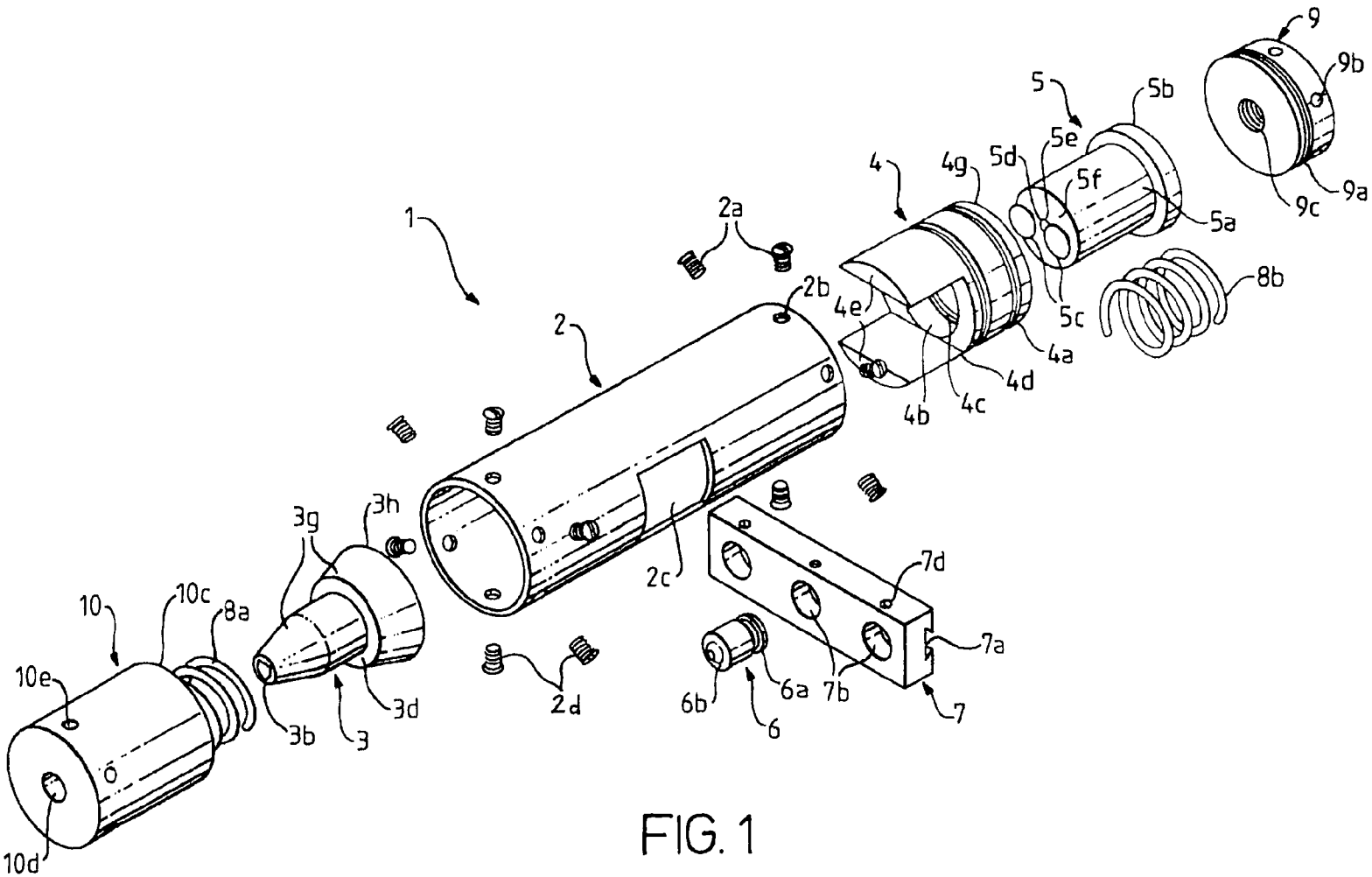
FIG. 1 is a perspective view of disassembled parts of a pipe flaring apparatus.
Figure 2:
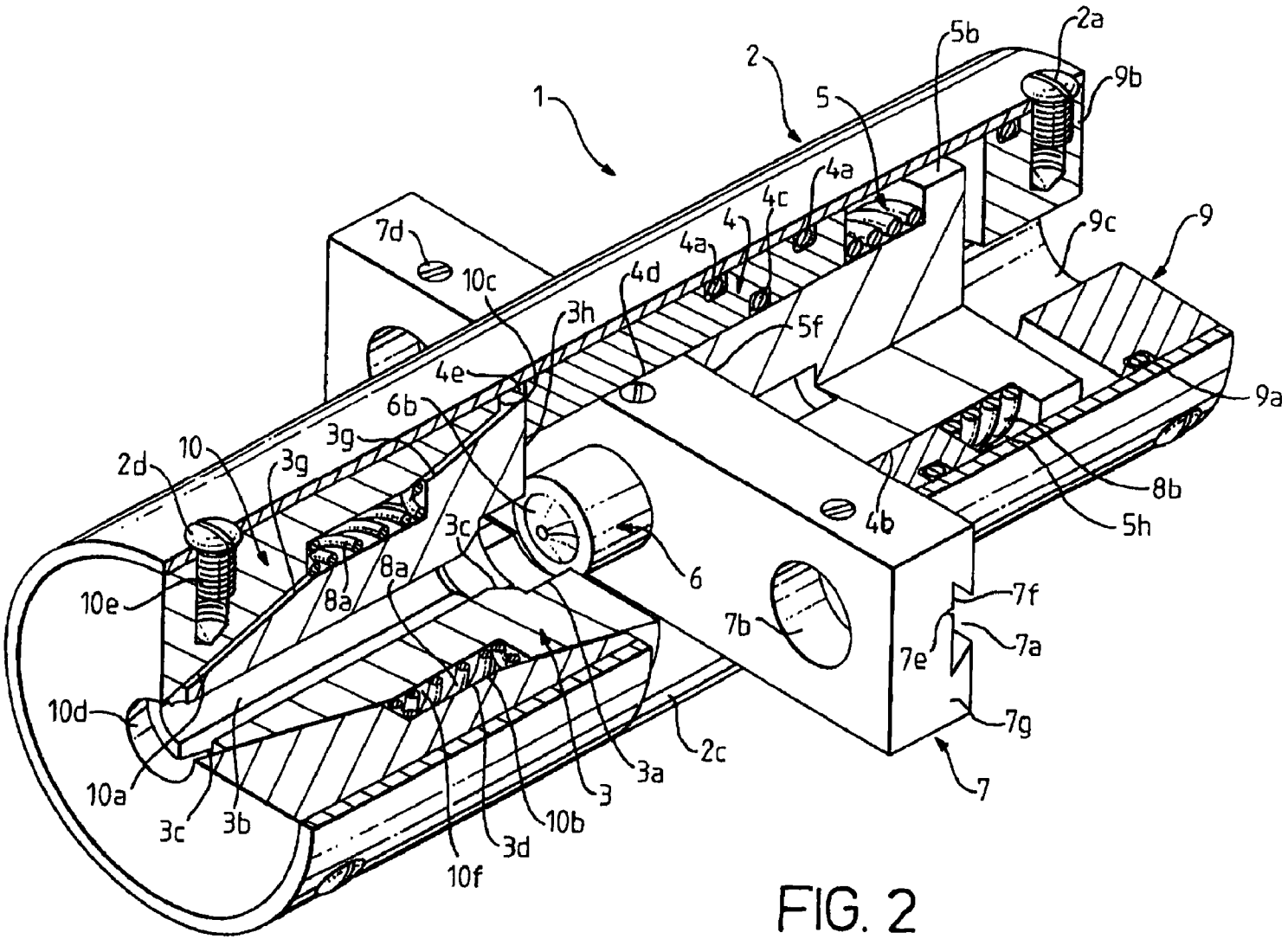
FIG. 2 is a perspective view of the pipe flaring apparatus with a section removed and with the apparatus in a deactivated rest position with a jawed chuck open.

Referring to FIG. 1, there is shown a cylindrical housing (2) into each opposite end thereof is located a three jawed chuck (3) and an outer piston (4), respectively. An hydraulically operable inner piston (5) is located for sliding movement within the piston (4). The three jawed chuck cooperates with a flaring head tool (6) mounted on a tool holder (7) movable in a diametrical direction of the cylindrical housing (2) through diametrically opposed windows (2*c*) thereof (FIG. 2). A helical compression spring (8*b*) is located on a reduced diametrical elongate cylindrical portion (5*a*) of the hydraulic inner piston (5) and a boss (9) is provided at one end of the cylindrical housing with radially extending threaded holes (9*b*) to hold the parts (4, 5) within the cylindrical housing and is locked in position within the housing by engagement screws (2*a*) which extend through holes (2*b*) in the housing into the holes (9*b*) of the boss (9).

Chuck clamp (10) is secured relative to the housing, at the opposite end of the housing to that end at which boss (9) is located, by screws (2*d*) engagable through the housing in radially extending screw threaded apertures (10*e*) at the outermost end of the chuck clamp (10).

The chuck clamp (10) has an external cylindrical surface of a diameter complementary with the diameter of the internal cylindrical surface of the housing (2), so as to be easily slidable into the housing. The screws (2*d*) hold the chuck clamp securely within the housing.

An aperture (10*d*) is shown in the outer end face of the chuck clamp (10) and an internal surface of the chuck clamp diverges outwardly towards the innermost end face (10*c*) of the chuck clamp (10) relative to the housing (2). A generally central section of the internal surface of the chuck clamp extends parallel to the axis of the housing (2) and with the chuck (3) defines a recess (10*f*) in which spring (8*a*) is located. As will be hereinafter described end face (1O*c*) acts as a stop to prevent further inward movement of outer piston (4) relative to housing (2) when outer piston (4) moves under hydraulic pressure applied through boss (9). End face (3*h*) of chuck (3) aligns with end face (10*c*) when the chuck and chuck clamp are fully engaged together.

Figure 3:
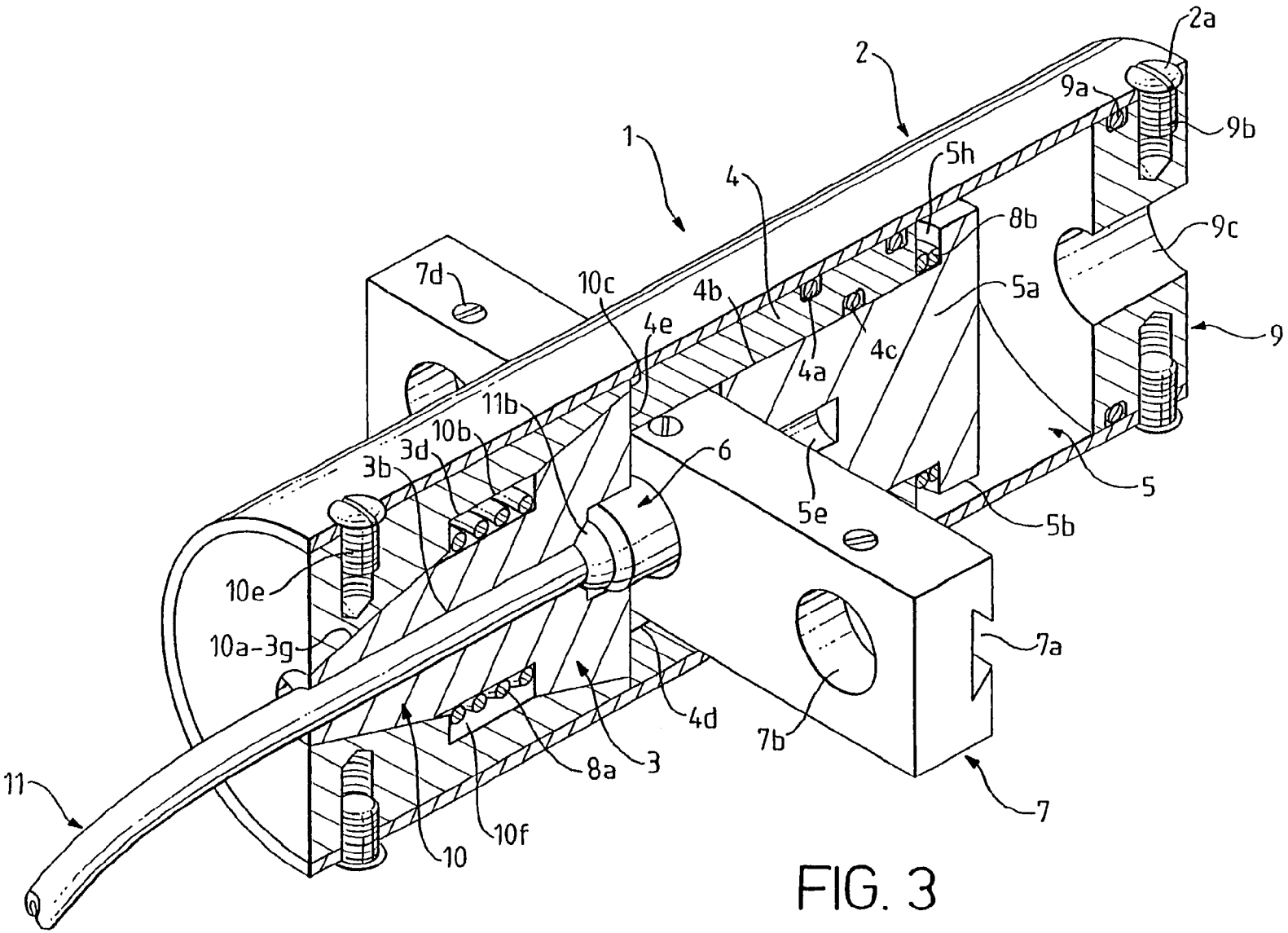
FIG. 3 is a perspective view of the pipe flaring apparatus with a section removed and with the tool fully activated under applied hydraulic pressure.
Figure 4:
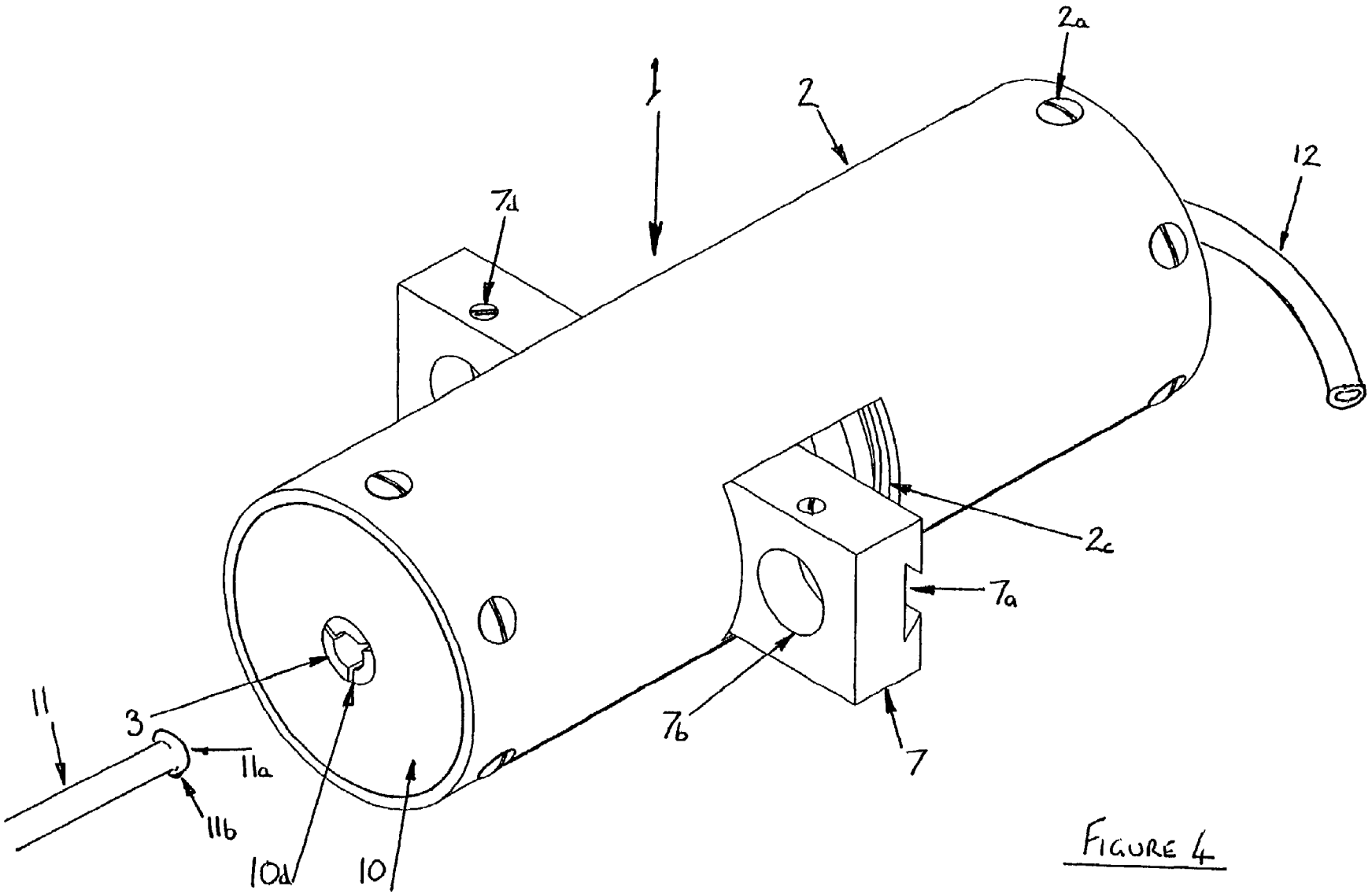
FIG. 4 is an overall perspective view of the pipe flaring apparatus in its rest position.
Figure 5:
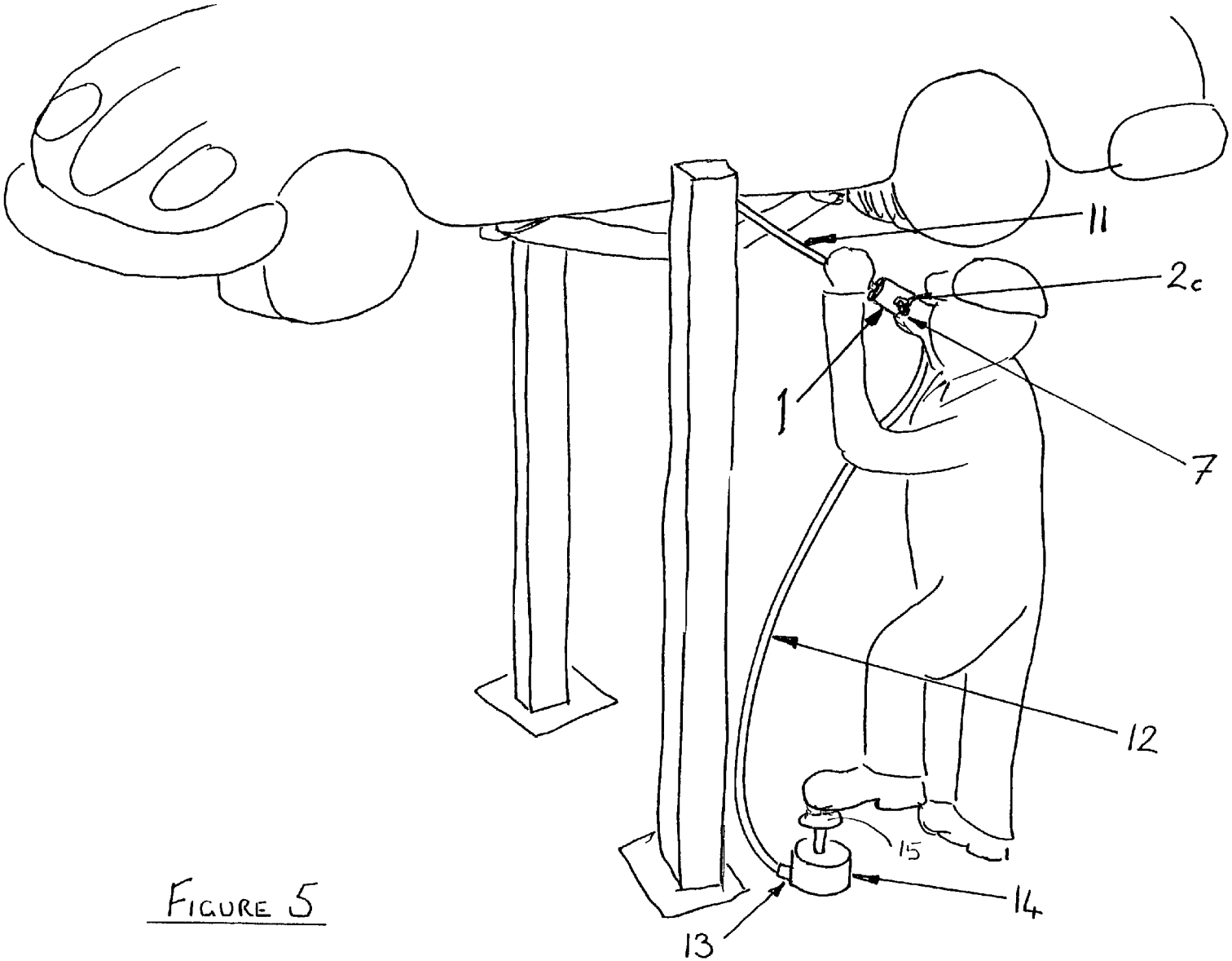
FIG. 5 is a diagrammatic perspective view of pipe flaring apparatus being used in a typical environment by an operator.

In FIG. 3, a pipe (11) is shown located within the three jawed clamping chuck (3) with the open end (11*b*) of the pipe flared following interaction, as will hereinafter be described with the flaring head tool (6). As shown in FIG. 4, at the opposite end of the housing (2) to the chuck clamp (10) a flexible pipe (12) extends from the housing via aperture (9*c*) in boss (9) and is used to vary hydraulic pressure applied to the pistons (4, 5). The pipe (12), as shown in FIG. 5, is connected via a connection (13) to a hydraulic pump (14) having a mechanical drive (15) operable by an operator's foot. The respective ends of the pipe (12) are sealingly fitted in screw threaded engagement with appropriate sealing elements in a manner which is well known in the art, which does not form part of the present invention and which will therefore not be described further.

As shown more clearly in the part sectional perspective views of FIGS. 2 and 3, the chuck (3) substantially fits within a tapered aperture (10*d*) within the chuck clamp (10). Helical compression spring (8*a*) is located in the recess (10*f*) defined between the chuck (3) and the chuck clamp (10) so as to push the chuck (3) outwardly relative to the chuck clamp (10), inwardly into the housing (2).

As shown in FIG. 2 outer piston (4) has an external cylindrical surface which is of a diameter complementary with the internal cylindrical surface of the housing (2) and is arranged to slide longitudinally of the housing. Two seals (4*a*) are provided for sealing the outer piston relative to the internal surface of the housing (2). The outer piston (4) has an internal cylindrical aperture (4*b*) in which there is located an annular seal (4*c*). Inner piston (5) is slidably engaged via its cylindrical surface (5*a*) with the aperture (4*b*), the seal (4*c*) sealing the inner and outer pistons one relative to the other.

The outer piston (4) also has a recess (4*d*) formed between two diametrically opposite axially extending arcuate portions of the cylindrical surface of piston (4). The two arcuate portions each have a flat inner surface diametrically opposed and lying parallel one relative to the other. Each arcuate portion has a transversely extending end face (4*e*). The tool holder (7) is located in recess (4*d*) for sliding movement back and forth in a diametrical direction of the piston (4). The windows (2*c*) on diametrically opposed sides of the housing (2) are arranged to align with the recess (4*d*) in the outer piston (4) to allow the tool holder in recess (4*d*) to extend outwardly of the housing (2).

As previously described the inner piston (5) slides within the inner aperture (4*b*) of the outer piston (4) and is sealingly engaged relative thereto by seal (4*c*). An increased diameter portion (5*b*) of the inner piston (5) serves as an end stop for helical compression spring (8*b*) located on the outer cylindrical surface (5*a*) of the inner piston (5) in a recess (5*h*) defined between the end stop (5*b*) and end face (4*g*) of the outer piston (4).

The inner piston (5) has a transverse surface (5*f*), innermost of the piston (5), relative to the housing (2). Two tool holder guides (5*c*) project outwardly from the surface (5*f*) and have large external surfaces and frustoconical support surfaces extending from the outer transverse surfaces thereof inwards towards the surface (5*f*). A detent (5*d*) located in an aperture (5*e*) between the two tool holder guides (5*c*) is operable to accurately locate the tool holder (7) in position on the guides (5*c*). The guides (5*c*) are located in groove (7*a*) of the tool holder (7). Such detents are not clearly shown in the tool holder (7) but one detent receiving recess (7*e*) is shown in the base surface (7*f*) of the groove (7*a*), illustrated at the end face (7*g*) of the tool holder (7). A whole series of the recesses (7*e*) are present along the surface (7*f*) so that the tool holder (7) can be accurately aligned anywhere along its length relative to the central axis of the elongate aperture (3*b*) through the chuck (3). In the rest position of the pistons the helical compression spring (8*b*) expands to force the inner piston (5) outwardly from the end of the outer piston (4).

The abutment surfaces (4*e*) of the outer piston (4) engage or abut end surface (3*h*) of the chuck (3).

The tool holder (7) is also provided with apertures (7*b*) therethrough for receiving one end of a flaring tool (6). Upper surface (7*h*) of the tool holder (7) has a series of screw threaded apertures in which screws are located, one associated with each aperture (7*b*). Each flaring tool (6) has a groove (6*a*) at its end remote from the flaring tool working surface (6*b*), into which a screw (7*d*) extends to hold the flaring tool on the tool holder.

The boss (9) located at the end of the housing (2) remote from the chuck clamp (10) is, as previously discussed, held relative to the end of the housing by screws (2*a*) in screw threaded apertures (9*b*). A sealing ring (9*a*) serves to seal the boss (9) relative to the housing (2). Threaded centrally located aperture (9*c*) receives one end of pipe (12) which is sealed relative to the boss (9) in any suitable manner known in the art as mentioned above.

The relative position of the various components of the automated pipe flaring tool (1) are shown in FIG. 2 to be in a rest position in which both compression springs (8*a*, 8*b*) are in their fully expanded conditions. The operation of the flaring tool (1) will now be described beginning from the rest position of FIG. 2 with an individual flaring tool (6) located in the central aperture (7*b*) of the flaring tool holder (7) and aligned with the longitudinal axis of the elongate aperture (3*b*) through the chuck (3).

As may be seen from FIG. 3 a pipe (11) to be flared is located within the chuck (3) until the end of the pipe engages the work surface (6*b*) of the flaring tool (6) with the tool holder (7) in its rest position. This will be substantially level with end face (3*h*) of the chuck (3). The positioning of the pipe in the correct position can be seen through the window (2*c*) in the housing (2).

As hydraulic pressure is applied to end face (5*g*) of the inner piston (5) via pipe (12) the spring (8*b*) partially compresses and then moves with inner piston (5) to move the outer piston (4) towards the chuck clamp (10). As the outer piston (4) moves towards the chuck clamp (10) its transverse end faces (4*e*) push against the end face (3*h*) of the chuck (3) to move the chuck inwardly of the chuck clamp. Such movement firstly has the effect of closing the three jaws of the chuck (3) around the pipe (11) as the tapered outer surface thereof slides inwardly of the inner tapered surface (10*a*) of chuck clamp (10), to firmly hold the pipe in position. Secondly, the compression spring (8*a*) compresses by the inward movement of chuck (3) into chuck clamp (10) and is thereby tensioned ready to push the chuck (3) outwardly of the chuck clamp (10) once the hydraulic pressure is released.

Once the pipe (11) is firmly clamped by the chuck (3) the outer piston (4) stops moving and the inner piston (5) continues to move compressing the spring (8*b*) further. The tool holder (7) fixedly mounted on the inner piston (5) for longitudinal movement therewith relative to the housing (2), moves the flaring tool (6) into the aperture (3*a*) of the chuck (3). As the tool (6) continues to move into the aperture (3*a*) the end of the pipe begins to flare outwardly because of the frustoconical formation of working surface (6*b*) of the flaring tool (6). As the inner piston (5) moves towards the chuck clamp (10) the end of the pipe (11) is forced into contact with tapered inner surface (3*c*) of the chuck (3). This provides the pipe (11) with a flared end (11*b*) as shown in FIG. 3.

When the hydraulic pressure is released the biasing forces within the springs (8*a*, 8*b*) begin to act with the spring (8*a*) forcing the chuck (3) away from the chuck clamp (10). Simultaneously, spring (8*b*) which is initially moved by chuck (3) via outer piston (4) continues to move with the outer piston (4). Spring (8*b*) then begins to exert pressure and forces the piston (5) longitudinally outwardly relative to the outer piston (4). The effect of this is to withdraw the flaring tool (6) from the aperture (3*a*) of the chuck (3).

During the release of the chuck (3) from the chuck clamp (10) radially extending springs (not shown) located between the three chuck jaws of the chuck (3) operate to force the chuck jaws apart thereby releasing the pipe (11) so that the pipe can be withdrawn through the chuck (3) and chuck clamp (10).

Conveniently, a number of different flaring tools (6) can be mounted on the tool holder (7) so that the end of the pipe can be flared gradually to avoid splitting of the pipe for example, and to more accurately obtain the correct flaring angle.

Although the embodiment shown in FIGS. 1 through 5 is described with reference to a single flaring, it may also be possible by appropriate shaping of the chuck (3) and working surface (6*b*) of the flaring tool (6) to use the same apparatus and method to perform a double or other flaring operation.

The three jawed chuck (3) is provided with a forming recess (3*a*) to assist in forming the flared end of a pipe and an elongate aperture (3*b*) in which a pipe (11) (FIG. 3) is located.

Defouling of the pipe end is achieved by the slot (3*c*) on the chuck (3) and the loose material is ejected easily through the window (2*c*) in the housing.

Furthermore, the helical springs (8*a*, 8*b*) can be of any mechanical/hydraulic form provided similar biasing action can be achieved as the springs (8*a*, 8*b*).

Although in the presently described embodiment the inner piston is described as sliding centrally through the outer piston, the two pistons may be arranged substantially differently, side by side for example.

The invention claimed is:

1. A pipe flaring tool for flaring an end of a pipe, said tool comprising:

a housing;

a clamping device disposed in said housing for releasably clamping said pipe and defining a die for receiving said end of said pipe;

a first piston slidable in said housing for applying a force to said clamping device to cause said clamping device to clamp said pipe;

a tool carrier insertable into said housing through a tool carrier receiving aperture to bring a forming tool for flaring the pipe end carried thereon into line with said die disposed in said housing; and a second piston slidable in said first piston for first applying a force to said first piston for sliding said first piston into engagement with said clamping device to apply said force and second for pressing said tool carrier towards said clamping device to move said forming tool into said end of the pipe.

2. A tool as claimed in claim 1 wherein said tool carrier comprises a plurality of tool holding stations at which respective said forming tools can be releasably fixed to said tool carrier.

3. A tool as claimed in claim 2, wherein said tool carrier is slideable on a mount that is provided on said second piston.

4. A tool as claimed in claim 3, wherein said tool carrier and said second piston are provided with a locating mechanism that defines respective positions at which said plurality of tool holding stations is in line with said clamping device.

5. A tool as claimed in claim 1, wherein said clamping device comprises a chuck having at least three jaws and a chuck clamp, said chuck being movable in a first direction against said chuck clamp by said force applied by said first piston whereby the chuck clamp applies a radially acting compressive force to said chuck.

6. A tool as claimed in claim 5, wherein said chuck comprises a tapering external surface that engages a complementary surface defined by said chuck clamp when the chuck is caused to move against said chuck clamp by said force applied by said first piston, said tapering external surface increasing in diameter in a second direction that is opposite said first direction.

7. A tool as claimed in claim 1, wherein said clamping device comprises a longitudinal axis and a spring biasing mechanism for opening said clamping device to permit insertion and removal of said end of the pipe by movement along said longitudinal axis.

8. A tool as claimed in claim 7, wherein said clamping device comprises a chuck having at least three jaws and a chuck clamp, said chuck being movable against said chuck clamp by said force applied by said first piston whereby said chuck clamp applies a radially acting compressive force to said chuck and said spring biasing mechanism comprises a spring acting between said chuck and said chuck clamp to bias said chuck away from said chuck clamp.

9. A tool as claimed in claim 8, wherein said spring biasing mechanism comprises springs acting between the jaws of said chuck to force the jaws apart.

10. A tool as claimed in claim 8, comprising a spring acting between said first and second pistons to bias said second piston away from said first piston and said chuck clamp.

11. A tool as claimed in claim 10, wherein said spring acting between said first and second pistons is stronger than the spring acting between the chuck and the chuck clamp whereby sliding motion of said second piston is transmitted to said first piston via said spring acting between said first and second pistons.

12. A pipe flaring tool for flaring an end of a pipe, said tool comprising:

a housing connectable to a power source;

a clamping device disposed in said housing for releasably clamping said pipe and defining a die for receiving said end of said pipe;

a piston slidable in said housing and driven by the power source, the piston for applying a force to said clamping device to cause said clamping device to clamp said pipe; and a tool carrier insertable into said housing through a tool carrier receiving aperture to bring a forming tool for flaring the pipe end carried thereon into line with said die disposed in said housing.

13. A tool as claimed in claim 12 wherein said tool carrier comprises a plurality of tool holding stations at which respective said forming tools can be releasably fixed to said tool carrier.

14. A tool as claimed in claim 12, wherein said tool carrier is slideable on a mount.

15. A tool as claimed in claim 13, wherein said tool carrier is provided with a locating mechanism that defines respective positions at which said plurality of tool holding stations is in line with said clamping device.

16. A tool as claimed in claim 12, wherein said clamping device comprises a chuck having at least three jaws and a chuck clamp, said chuck being movable in a first direction against said chuck clamp by said force applied by said piston whereby the chuck clamp applies a radially acting compressive force to said chuck.

17. A tool as claimed in claim 16, wherein said chuck comprises a tapering external surface that engages a complementary surface defined by said chuck clamp when the chuck is caused to move against said chuck clamp by said force applied by said piston, said tapering external surface increasing in diameter in a second direction that is opposite said first direction.

18. A tool as claimed in claim 12, wherein said clamping device comprises a longitudinal axis and a spring biasing mechanism for opening said clamping device to permit insertion and removal of said end of the pipe by movement along said longitudinal axis.

19. A tool as claimed in claim 18, wherein said clamping device comprises a chuck having at least three jaws and a chuck clamp, said chuck being movable against said chuck clamp by said force applied by said piston whereby said chuck clamp applies a radially acting compressive force to said chuck and said spring biasing mechanism comprises a spring acting between said chuck and said chuck clamp to bias said chuck away from said chuck clamp.

20. A tool as claimed in claim 18, wherein said spring biasing mechanism comprises springs acting between the jaws of said chuck to force the jaws apart.

21. A tool as claimed in claim 12, wherein the power source comprises a source of pressurized fluid.

* * * * *